United States Patent [19]

Nakamura

[11] 4,420,080

[45] Dec. 13, 1983

[54] RE-SEALABLE DISPENSER-CONTAINER

[76] Inventor: Kenji Nakamura, 3-7, Nishiawaji 6-chome, Higashiyodogawa-ku, Osaka, Japan

[21] Appl. No.: 320,554

[22] Filed: Nov. 12, 1981

Related U.S. Application Data

[62] Division of Ser. No. 210,682, Nov. 26, 1980, abandoned.

[51] Int. Cl.[3] ..... B65D 81/24

[52] U.S. Cl. ..... 206/449; 206/607; 206/613; 206/621; 206/629; 206/813; 206/494; 220/258

[58] Field of Search ..... 206/205, 613, 607, 629, 206/621, 631, 632, 633, 812, 813, 494; 229/62; 220/258

[56] References Cited

U.S. PATENT DOCUMENTS

| | | | |
|---|---|---|---|
| 3,438,565 | 4/1969 | Lunt et al. | 206/613 |
| 3,580,466 | 5/1971 | Thelen et al. | 206/607 |
| 3,819,043 | 6/1974 | Harrison | 206/449 |
| 3,851,762 | 12/1974 | Liblick | 206/813 X |
| 3,951,331 | 4/1976 | Smith et al. | 220/258 |
| 4,131,195 | 12/1978 | Worrell, Sr. | 206/205 |
| 4,192,420 | 3/1980 | Worrell, Sr. et al. | 220/258 |

*Primary Examiner*—Joseph Man-Fu Moy
*Attorney, Agent, or Firm*—Austin R. Miller

[57] ABSTRACT

The present invention relates to a re-sealable dispenser-container and a process for producing the container. The dispenser-container comprises a main container body made of impervious material with at least one opening, a flap having a pressure-sensitive adhesive surface and fixed to the main body at one end thereof to cover the opening, and a non-adhesive member adhered to the adhesive surface and which member is used for closing the opening in order to prevent the adhesive surface from directly contacting the contents. The process comprises punching a perforated line in a sheet used for the main body, disposing a flap on the sheet so as to cover the perforated line, fixing one end of the flap to the sheet, and sealing the sheet longitudinally and transversely.

1 Claim, 16 Drawing Figures

RE-SEALABLE DISPENSER-CONTAINER

This is a division, of application Ser. No. 210,682, filed Nov. 26, 1980 now abandoned.

BACKGROUND OF THE INVENTION

The present invention relates to a re-sealable dispenser-container which is suitable for containing sheet-like materials made from natural or synthetic fibers, such as tissue, paper, woven or knitted fabric, non-woven fabric, sheeted and cut cotton layers (cotton balls) for make-up and the like. More particularly, the re-sealable dispenser-container of the present invention is suitable for containing sheets of fiber materials which are wetted with water, toilet water or a medicinal liquid.

The present invention also relates to a process for producing a re-sealable dispenser-container.

Recently, tissues wetted with water, toilet water, medicinal liquid, e.g. disinfectant liquid, and the like have been utilized to clean hands or face, or to remove make-up. There are many kinds of containers for wet tissue, such as boxes and bags. Many conventional containers are plastic products made by injection molding or vacuum molding, so that the containers are bulky and are not suitable for carrying. Further, the cost of producing such a container is comparatively high.

Japanese unexamined Utility Model Publication No. 49-47081(47018/74) discloses a flat container made of a waterproofing sheet. The container is produced by folding the sheet into thirds, having a bottom part, a middle part and a top part and then bonding both side edges of the bottom part and the middle part. The middle part has an opening for taking out contents therefrom, whereas the top part acts as a lid for covering the opening and the top part has an adhesive layer coated on a surface of the top part facing the middle part, along the edges of the top part, in a ⊔ shape. The top part is re-sealably adhered to the middle part by means of the adhesive layer. Such a container may be portable and can be used to contain wet tissues. However, this container has several difficulties. For example, the odor of the adhesive affects the contents because the air inside the container mixes with the air between the middle part and the top part, i.e. the adhesive layer, because of the opening. As a result, the contents change in odor or quality. It is difficult to automatically coat adhesive on the inside surface of the top part in a ⊔ shape and also difficult to form the adhesive layer at a constant position in each container, so that reliable sealing of the top part and the middle part is not ensured. The container cannot be made in series production.

SUMMARY OF THE INVENTION

It is an object of the present invention to provide a dispenser-container which is able to repeatedly and reliably seal the opening of a main container body after removing the contents therefrom.

Another object of the present invention is to provide a re-sealable dispenser-container in which the odor of the adhesive to be used for sealing does not affect the contents in the main container body.

A further object of the invention is to provide a re-sealable dispenser-container which is able to assure the user that no-one has taken the contents out of the container before the user uses it.

It is another object of the invention to provide a re-sealable dispenser-container which can contain two different types of material without any risk of mutual contamination.

Still a further object of the invention is to provide sheet-like fiber materials for make-up or toilet articles, to be contained in a re-sealable portable container made of impervious material.

An even further object of the invention contemplates the provision of a process for producing a re-sealable dispenser-container easily and at comparatively low cost.

According to the present invention, a re-sealable dispenser-container comprises a main container body made of impervious material and having at least one opening for removing the contents, the whole body or at least a part, in which the opening is formed, being made of an impervious sheet-like material; and a sealing means for repeatedly adhering to said main body around one or each opening and sealing said opening without adhering to the contents; said means being attached to said main body at one end of the sealing means.

A re-sealable dispenser-container of the invention may have a partition which divides the interior of the main container body into two spaces. At least one of spaces has a re-sealable opening.

The dispenser-container of the invention can be used to contain a variety of items, i.e. paper, tissue, candy, nails, cotton balls etc. More particularly, the dispenser-container of the invention is very useful as it can contain sheet-like fiber materials such as tissue, gauze, paper, woven or knitted fabric, non-woven fabric, cotton balls for make-up, and so on, and especially suitable for wetted sheet-like fiber materials.

According to the invention, a process for producing a re-sealable dispenser-container comprises, punching a perforated line drawn in a closed shape, in a sheet;

disposing a flap with an adhesive surface on the sheet in such a manner that the adhesive surface contacts with the sheet and that the flap covers said perforated line;

fixing one end portion of said flap to said sheet; and sealing the sheet longitudinally and transversely.

According to the present invention, another process for producing a re-sealable dispenser-container comprises:

punching an opening in a sheet;

disposing a flap with an adhesive surface on one side of the sheet in such a manner that the adhesive surface contacts with the sheet and that the flap covers said opening;

fixing one end portion of said flap to the sheet;

disposing a non-adhesive member having a shape larger than said opening on the opposite side of the sheet over said opening so that the non-adhesive member adheres to the adhesive surface of the flap through the opening; and sealing the sheet longitudinally and transversely.

Other and further objects, features and advantages of the invention will appear more fully from the following description.

DETAILED DESCRIPTION OF THE PREFERRED EMBODIMENT

Figure 1:
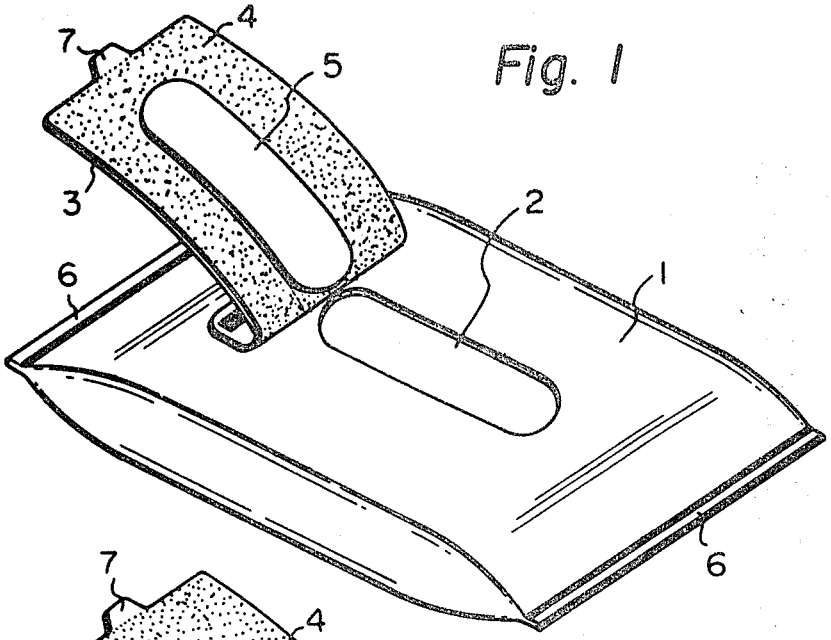
FIG. 1 is a perspective view of a re-sealable dispenser-container of the present invention.

The present invention will now be described in detail referring to the accompanying drawings. As shown in FIG. 1, a re-sealable dispenser-container according to the present invention comprises a main container body 1 made of impervious sheet-like material and provided with an opening 2, a flap 3 positioned to cover the opening and attached to the main body at one end of the flap, which flap having a pressure-sensitive adhesive surface 4 facing the main body 1, and a non-adhesive member 5 adhered to the surface 4 at a position corresponding to the opening 2 in the main body 1.

The non-adhesive member 5 has the same or a larger area than the opening 2 and is positioned so as to substantially cover the opening 2 when the flap 3 is closed, that is, when the whole of the flap 3 contacts with the main body 1 and the pressure-sensitive adhesive surface 4 adheres to the main body 1, so that the non-adhesive member 5 can close the opening 2. Therefore, the non-adhesive member i.e. closing member 5 prevents the adhesive surface 4 from directly contacting the contents in the main body 1. The contents can be kept clean and the odor of the adhesive does not affect the contents. The dispenser-container of the invention can be used to contain various things, and the container is very suitable for containing things which should be kept clean or hygienic, such as foodstuffs, wetted gauze or tissue or cotton balls used for disinfecting, or for make-up or for removing make-up and so on.

The shape of the opening 2 can be appropriately designed in the form of a circle, rectangle, diamond shape, ellipse, or the like.

A main container body 1 is a film made of synthetic resins such as polyethylene, polyester, polypropylene, polyvinyl chloride, polyamide, acetate, cellophane, etc., and the film may be single layer or a laminated layer. The film may be a laminated layer of the above-mentioned film and aluminum sheet. The main container body as shown in FIG. 1 is a flat bag. Such bag is made of a sheet by bonding longitudinal edges of the sheet and then bonding both transverse end edges 6. The bonded longitudinal edges are not shown in FIG. 1 because they are in the back of the flat bag. However, a flat main container body may be produced by bonding the transverse edges and the longitudinal edges of two or more superimposed sheets. Bonding edges of film may be carried out by heat-sealing, ultrasonic sealing or high-frequency sealing.

A flap 3 may be made of the same material as mentioned above in connection with the main container body. The flap may be fixed to the main body by means of heat-sealing, ultrasonic sealing, high-frequency sealing, or adhesive bonding. The fixing means is appropriately selected in accordance with material of the main body 1. The flap 3 has a larger area than the opening 2 in the main body 1 in order to completely cover the opening. The flap 3 may be in various shapes such as a circle, a rectangle, an ellipse, a racing track shape, and so on. The inside surface of the flap 3 facing the main container body 1 is coated with a pressure-sensitive adhesive such as an acrylic adhesive, rubber adhesive, polyester adhesive, polyolefin adhesive, and the like, which adhesive may be coated by means of roller coating, knife coating or spray coating. If the flap 3 and the closing member 5 are transparent, the state of the contents can be readily seen.

A flap 3 may be provided with a projecting part 7 at the free end thereof in order to easily pick up the flap with the fingers to open the flap. Preferably the projecting part 7 is not coated with adhesive.

Figure 2:
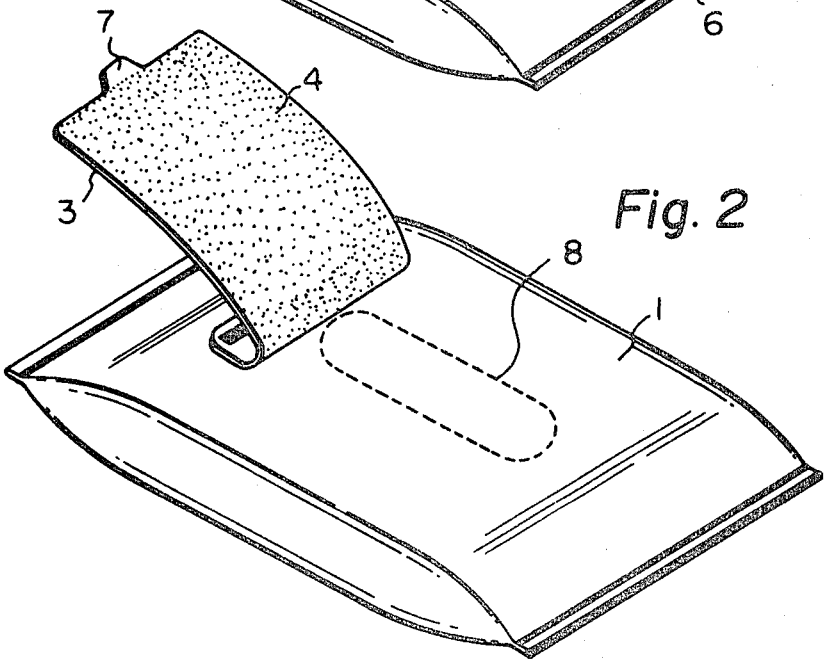
FIG. 2 illustrates an embodiment of the re-sealable dispenser-container as shown in FIG. 1, showing a state of the main container body before use, the flap being lifted.
Figure 3:
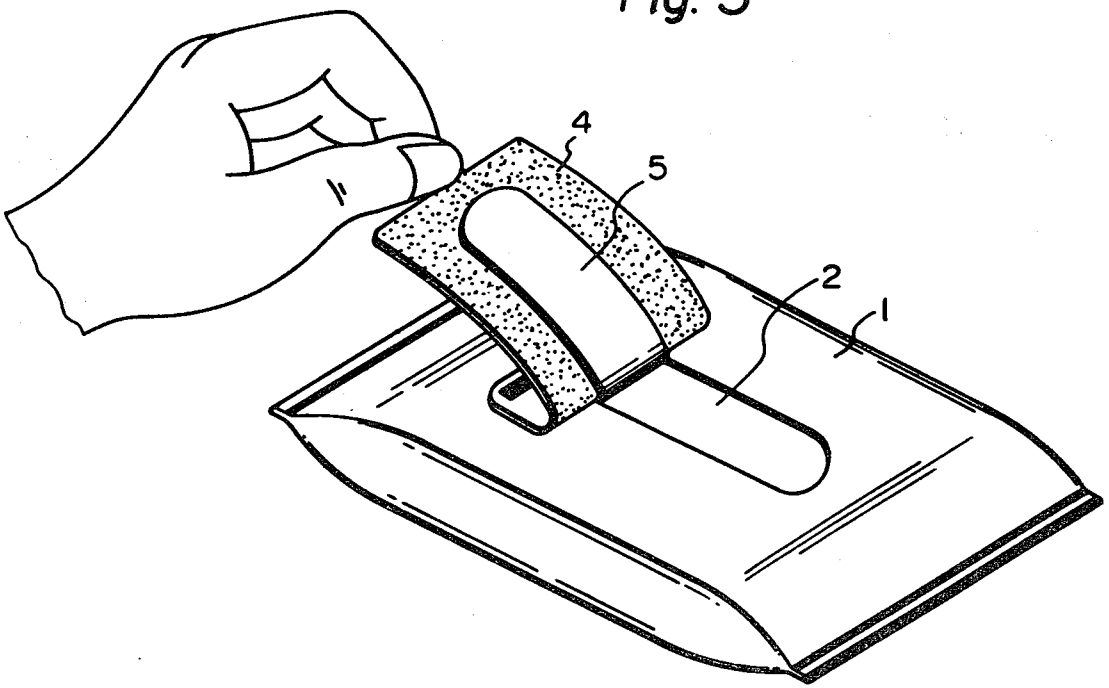
FIG. 3 is a perspective view illustrating a state of the dispenser-container as shown in FIG. 2, where a part of the main body of the container is removed and attached to the flap as occurs during use of the container.

According to an embodiment of the invention as shown in FIGS. 2 and 3, a non-adhesive member, i.e. a closing member 5, is provided as part of the main body 1 before use. In FIG. 2, in order to clearly understand the state of the main body 1 before use, a flap 3 is provisionally opened, but actually the flap 3 is closed and adheres to the main body 1. As shown in FIG. 2, a perforated line 8 drawn in a complete shape such as ellipse, a circle, a rectangle and so on, is formed on the main body 1 by means of punching. Before use, the flap 3 covers the perforated line 8 and adheres to the main body including the part encircled by the perforated line 8. Upon first use of the contents, one would take the projecting part 7 of the flap 3, pull up and open the flap 3. As shown in FIG. 3, when the flap 3 is opened, the main body 1 is broken along the perforated line 8, so that the part encircled by the perforated line 8 adheres to the flap 3 and is removed from the main body 1. The removed part becomes a non-adhesive member 5 on the flap 3, and an opening 2 is formed in the main body 1 by the removal of said part. Thus, the removed part i.e. non-adhesive member 5 is always attached to the flap 3.

After taking a portion of the contents out of the main body 1, the flap 3 is again closed to seal the main body and the non-adhesive member 5 is just fitted over the opening 2 and closes the opening 2.

Figure 4:
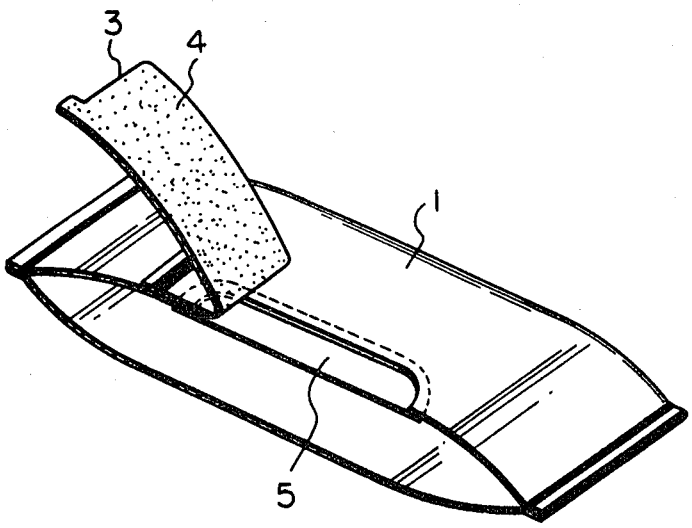
FIG. 4 is a perspective sectional view of another embodiment of the dispenser-container as shown in FIG. 1, showing a state of the main container body before use, the flap being lifted.
Figure 5:
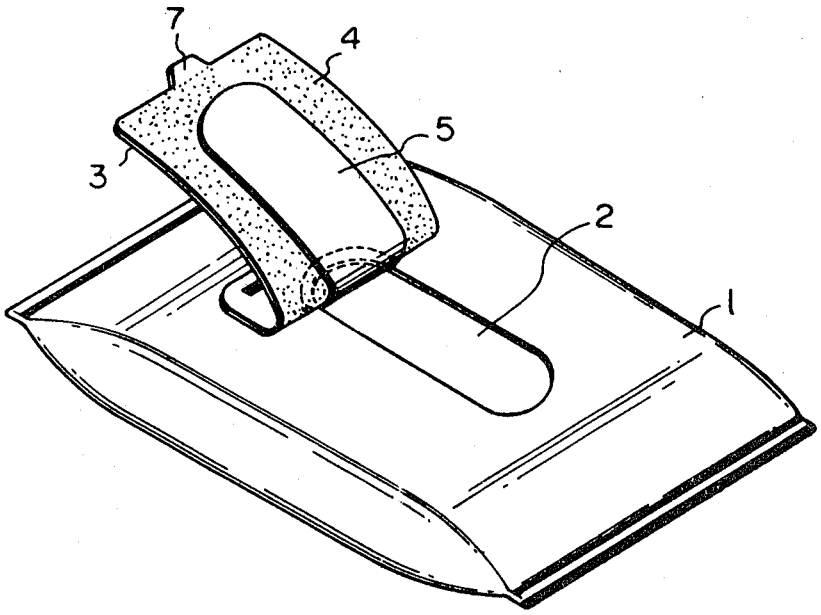
FIG. 5 is a perspective view illustrating a state of the dispenser-container shown in FIG. 4, where a non-adhesive member is taken out through an opening in the main body and is attached to a flap, when the user begins using the dispenser-container.

According to another embodiment of the invention as shown in FIGS. 4 and 5, a non-adhesive member 5 is provided as a member independent of a main body 1. FIG. 4 illustrates the state of the main body 1 and the non-adhesive member 5 before use, and a flap is provisionally opened, like FIG. 2. Before use, the non-adhesive member 5 is positioned inside the main body 1 to close the opening in the main body and is adhered to the adhesive surface 4 of the flap 3 through the opening. When first using the contents, the flap 3 is gradually lifted beginning from the free end of the flap, together with the non-adhesive member 5, the non-adhesive member 5 being taken out through the opening 2 (see FIG. 5). After using a portion of the contents the flap 3 with the non-adhesive member 5 is closed. The non-adhesive member 5 is always attached to the flap 3 and is able to cover and close the opening 2. In this embodiment, the non-adhesive member has sufficient shape and area to completely cover the opening 2. Preferably it has a shape similar to and larger than the opening 2. The non-adhesive member 5 is preferably made of a comparatively flexible film of synthetic resisn such as polyethylene, polypropylene, polyamide, polyvinyl chloride, and the like.

Figure 6:
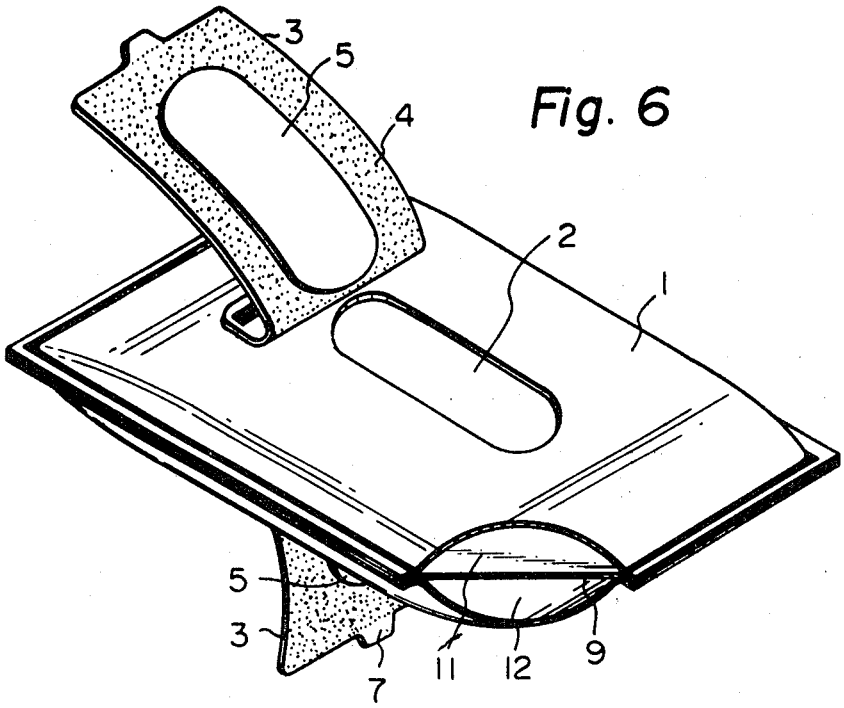
FIG. 6 is a perspective view, partly broken away to shown interior construction, of an embodiment of a dispenser-container of the invention, which container has two spaces in its interior.
Figure 7:
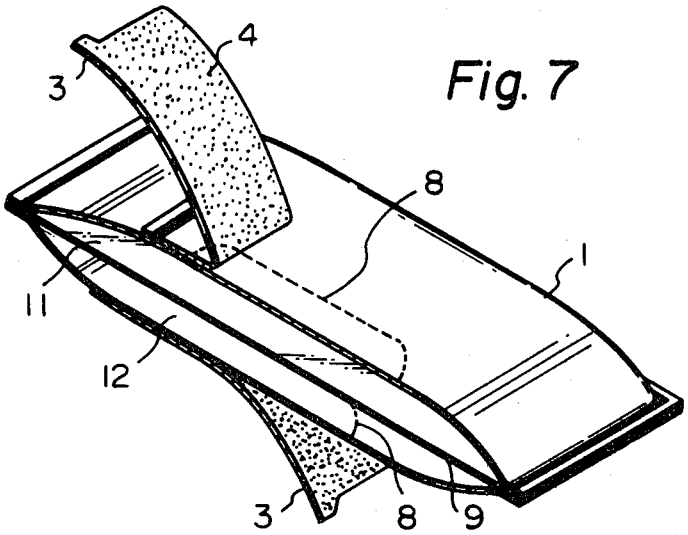
FIG. 7 is a perspective sectional view illustrating the interior of the dispenser-container as shown in FIG. 6 and the state of the main body as shown in FIG. 2.
Figure 8:
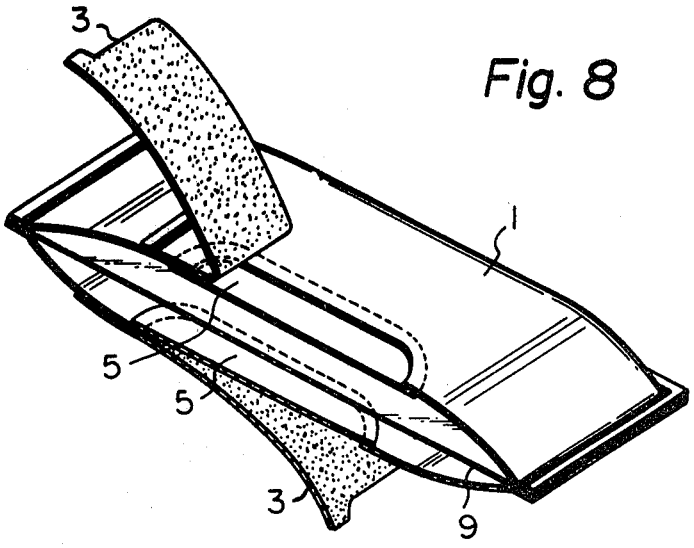
FIG. 8 is a perspective sectional view of another embodiment of the dispenser-container as shown in FIG. 6, illustrated in the same state as shown in FIG. 4.

FIG. 6 illustrates an embodiment of a dispenser-container of the present invention. In this embodiment, a main body 1 is provided with a partition 9 in its interior. The partition 9 divides the interior of the main body 1 into two spaces 11 and 12, each space, 11 and 12, having an opening 2. A flap 3 with a non-adhesive closing member 5 is provided to cover each opening 2. The partition 9 is made of a film of synthetic resin as used for a main body 1, and preferably the circumference of the partition 9 on both sides may be coated with a hot-melt adhesive having a lower melting point than the main body. FIGS. 7 and 8 respectively are perspective sectional views of a dispenser-container as shown in FIG. 6, and illustrate the state of the main body 1 before use, a flap 3 being provisionally opened as in FIGS. 2 and 4. In this embodiment a non-adhesive closing member 5 is alternatively a part of a main body 1 as shown in FIG. 7 or a member independent of the main body 1 as shown in FIG. 8, in the same manner as described before in connection with FIGS. 2 through 5.

Such a dispenser-container having two spaces is portable and very convenient for containing two different kinds of contents, for example dry tissue and wet tissue, chocolate and candy, pills for headaches and stomachaches, and so on.

Figure 9:
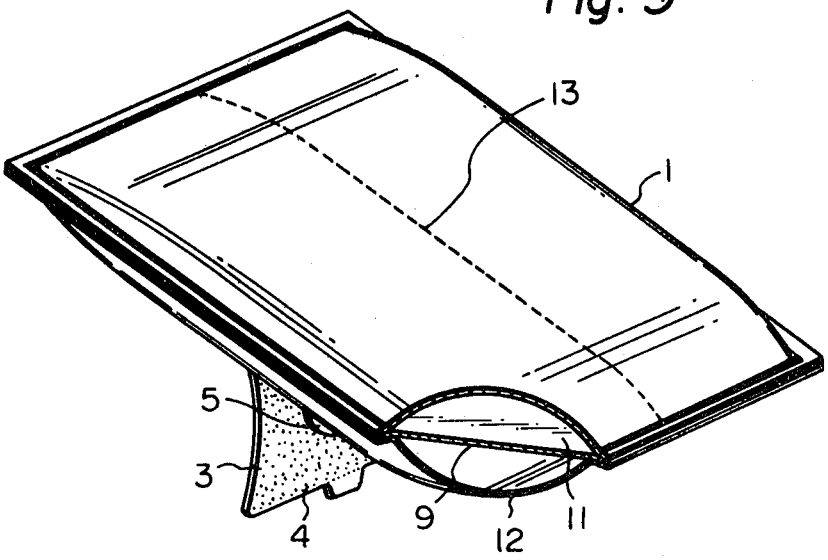
FIG. 9 is a perspective view of an embodiment of a dispenser-container partially broken away, the container having two spaces in its interior, a flap being provided for one of spaces and a perforated straight line being provided for the other space.

FIG. 9 illustrates another type of a dispenser-container, wherein an interior of a main body 1 is divided into two spaces 11 and 12 by a partition 9. One of the spaces 12 has an opening (not shown), a flap 3 with an adhesive surface 4 and a non-adhesive closing member 5. For the other space 11, a straight perforated line 13 is provided in the main body 1, which main body can be easily broken along the perforated line 13 to take out contents therefrom.

Figure 10:
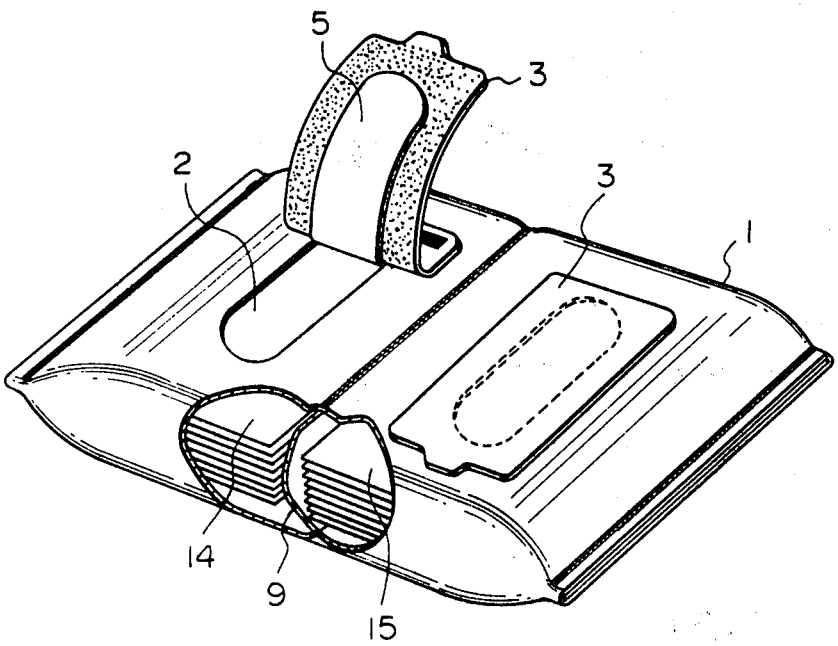
FIG. 10 is a perspective view, partly broken away to show interior construction, of another embodiment of a dispenser-container.

FIG. 10 illustrates another embodiment of a dispenser-container. In this embodiment, the interior of a main body 1 is divided into two spaces by a partition 9, the spaces being arranged side by side. Each space has an opening 2 and a flap 3 with a non-adhesive member 5 provided for each opening to seal the opening 2. Each space may contain different contents 14 and 15.

Figure 11:
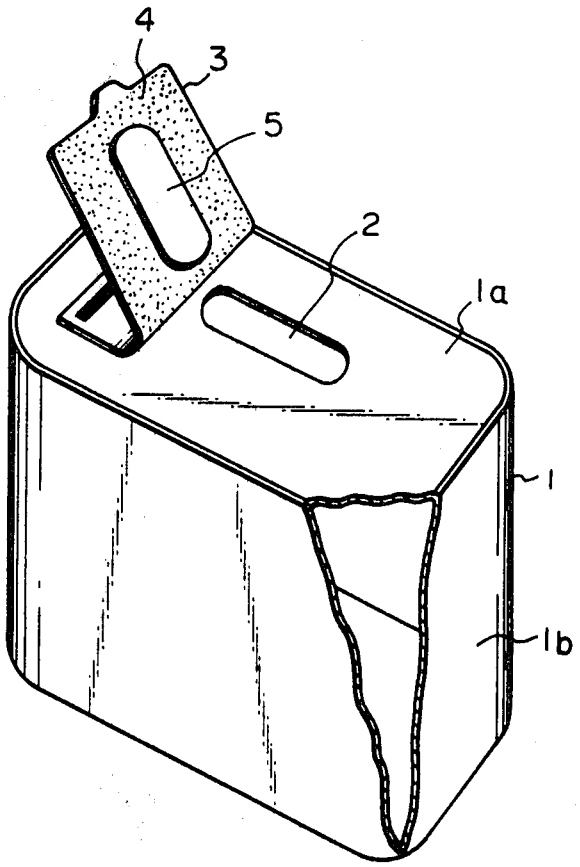
FIG. 11 illustrates an embodiment of a dispenser-container of the invention.

Another embodiment of the present invention is illustrated in FIG. 11, wherein a main body 1 is not flat, but is cubic or cylindrical. In this embodiment, the main body 1 may be made of impervious film as mentioned regarding the first embodiment, with the entirety or at least the part of the main body 1*a* in which an opening 2 and a flap 3 with a non-adhesive closing member 5 are provided being made of impervious film. The remaining part 1*b* may be made of plastic by means of molding. The opening 2, the flap 3 with an adhesive surface 4 and a non-adhesive closing member 5 are provided in the same manner as explained in FIGS. 1 through 5.

Figure 12:
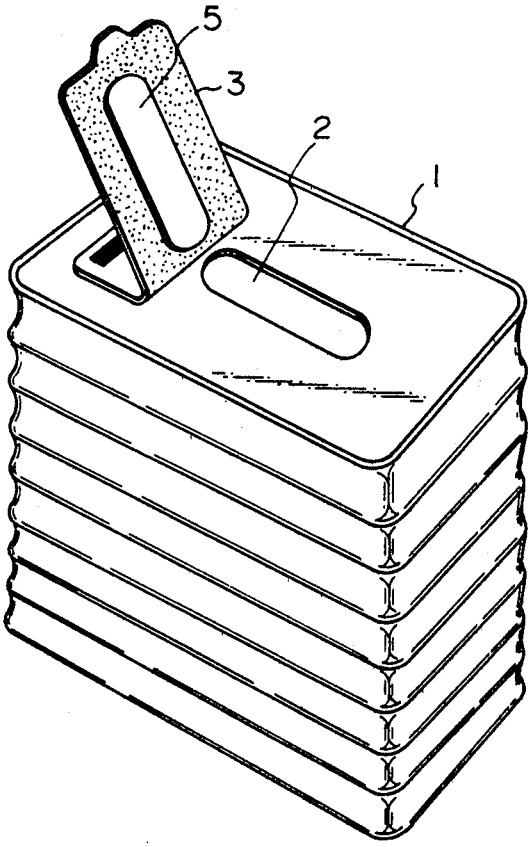
FIG. 12 is a perspective view of one embodiment of a dispenser-container of the invention.

FIG. 12 illustrates a modified dispenser-container, which is different from the container of FIG. 11 in that the main body 1 is bellows-shaped. Therefore, in the container of FIG. 12 it is possible to lessen the volume when contents are used or are reduced.

Figure 13:
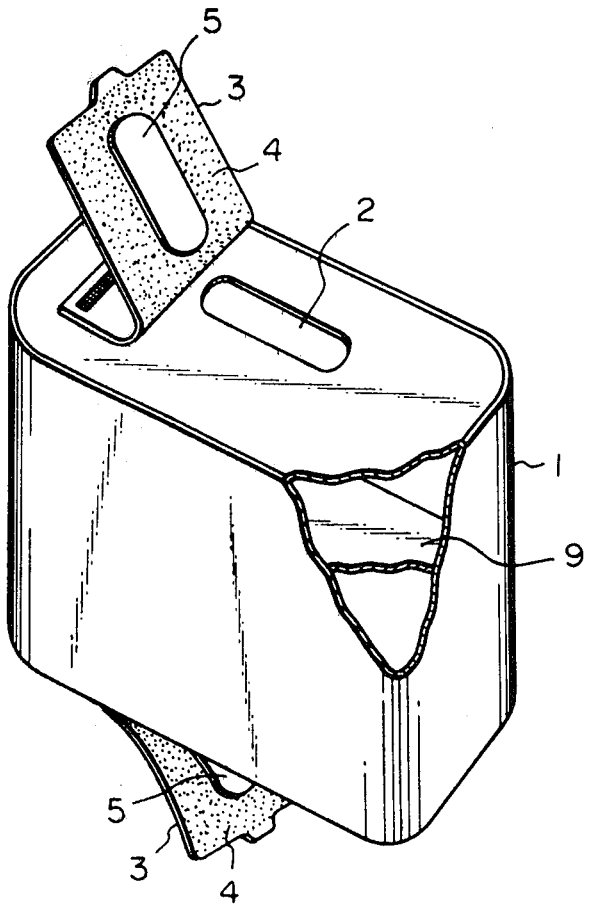
FIG. 13 is a perspective view, partly broken away, of another embodiment of a dispenser-container of the invention.

A further embodiment shown in FIG. 13 is similar to the container shown in FIG. 11, except for the following. In this enbodiment, the interior of a main body 1 is divided into two spaces, each space having an opening and the opening is sealed by means of a flap 3 with an adhesive surface 4 and a non-adhesive closing member 5 on the surface 4. This dispenser-container can contain two different kinds of materials. The partition 9 is made of a film of synthetic resins such as mentioned in connection with the embodiment of FIG. 6.

Regarding the embodiments as shown in FIGS. 1 through 13, contents to be accomodated in the interior of a main container body 1 are preferably contained before completion of the forming of the dispenser-container from one or more sheet-like materials, i.e. before sealing the edges of a sheet or sheets longitudinally and transversely.

Figure 14:
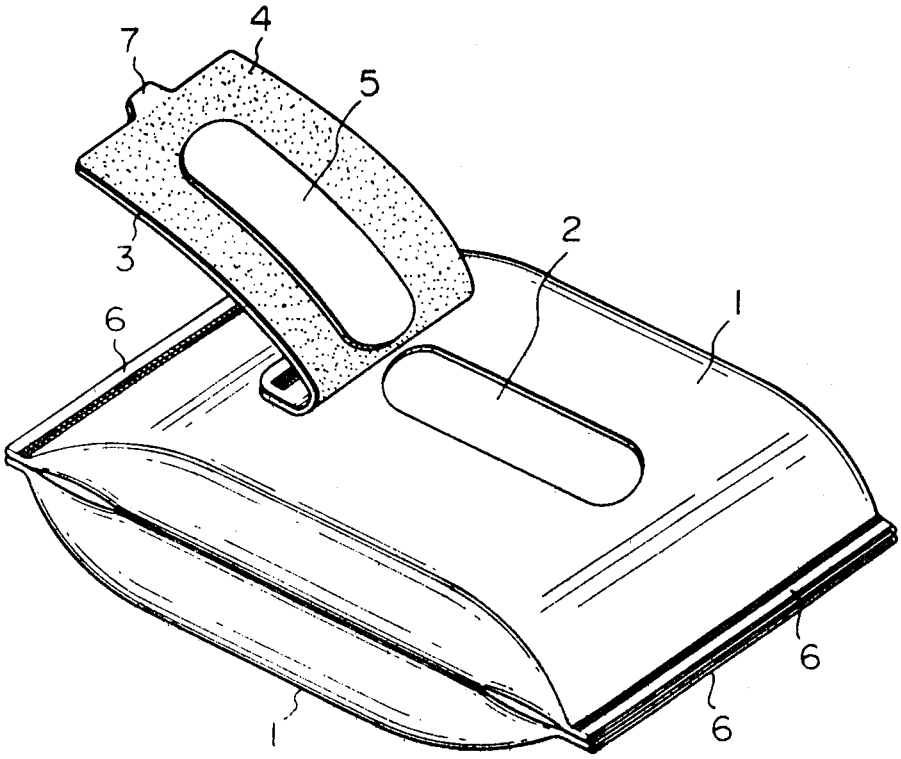
FIG. 14 is a perspective view of an embodiment of a dispenser-container of this invention.

FIG. 14 illustrates a modified dispenser-container, in which two separate main bodies 1 and 1 are kept together by bonding their transverse end edges 6, 6. One or both of the main bodies 1 has an opening 2 and is provided with a flap 3 and a non-adhesive member 5. Preferably, one of the main bodies does not have an opening, but has a straight perforated line as shown in FIG. 9 in order to break the main body 1 along the perforated line for removing the contents. In this embodiment, different contents may be contained in the respective main bodies. For example, wetted tissues are accomodated in a main body with the flap, and dry tissues are accomodated in another main body with a perforated line.

Figure 15:
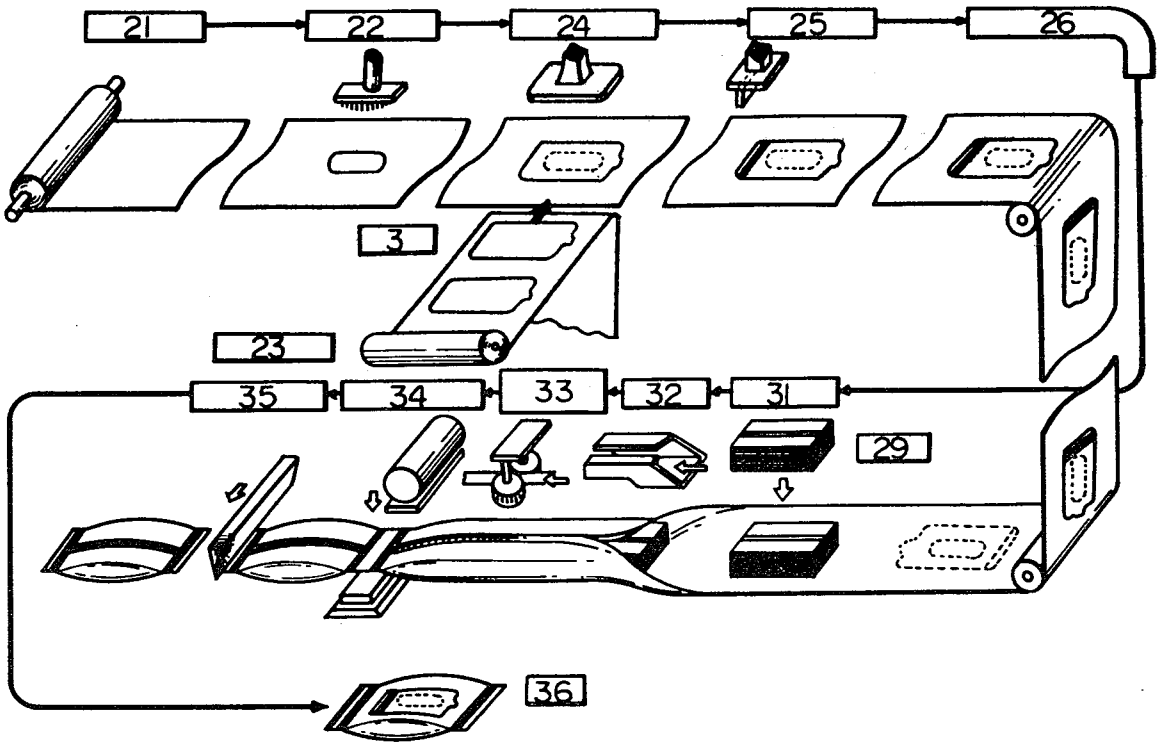
FIG. 15 is a flow sheet illustrating a process for producing a re-sealable dispenser-container of the invention.

Referring to FIG. 15, one embodiment of the process of the invention will now be described. An impervious continuous sheet for a main body of a dispenser-container, made of synthetic resins such as polyethylene, polypropylene, polyamide, polyester and so on, is fed from a roll of sheet 21 to a punching machine 22, wherein a perforated line drawn in a closed shape, such as an ellipse, a circle, a rectangle, etc., is punched in the sheet 21. Flaps 3, one side i.e. one surface of which has been coated with pressure-sensitive adhesive, having been made ready beforehand in such a manner that the flaps 3 are mounted on a roll of continuous sheet 23 for flaps. A flap 3 is removed from the sheet 23 and is disposed on the sheet 21 for a main body in such a way that the flap 3 covers the perforated line in the sheet 21 and that the adhesive surface of the flap faces the sheet 21, by means of a machine 24 for disposing a flap in place, which machine is a kind of labeling machine. The flap 3 is fixed to the sheet 21 at one end of the flap by a heat-sealer 25. Then the sheet 21 is guided by means of a guiding unit 26 comprising a plurality of guide rollers, so as to turn over the sheet 21. Contents 29, for example sheet-like fiber materials such as tissue, gauze, and the like, are mounted on the sheet 21 by means of a device 31 for supplying contents. Then the sheet is passed through a guide member 32 to wrap the contents 29 and to put the longitudinal edges of the sheet 21 together with each other. The longitudinal edges of the sheet 21 are sealed by means of a center heat-sealer 33. Further the sheet 21 is sealed in the transverse direction both in front and behind the contents by means of another heat-sealer 34, and the transverse sealed portion of the sheet 21 is cut by a cutting machine 35. As a result, the finished product, i.e. a re-sealable dispenser-container 36 is obtained.

Figure 16:
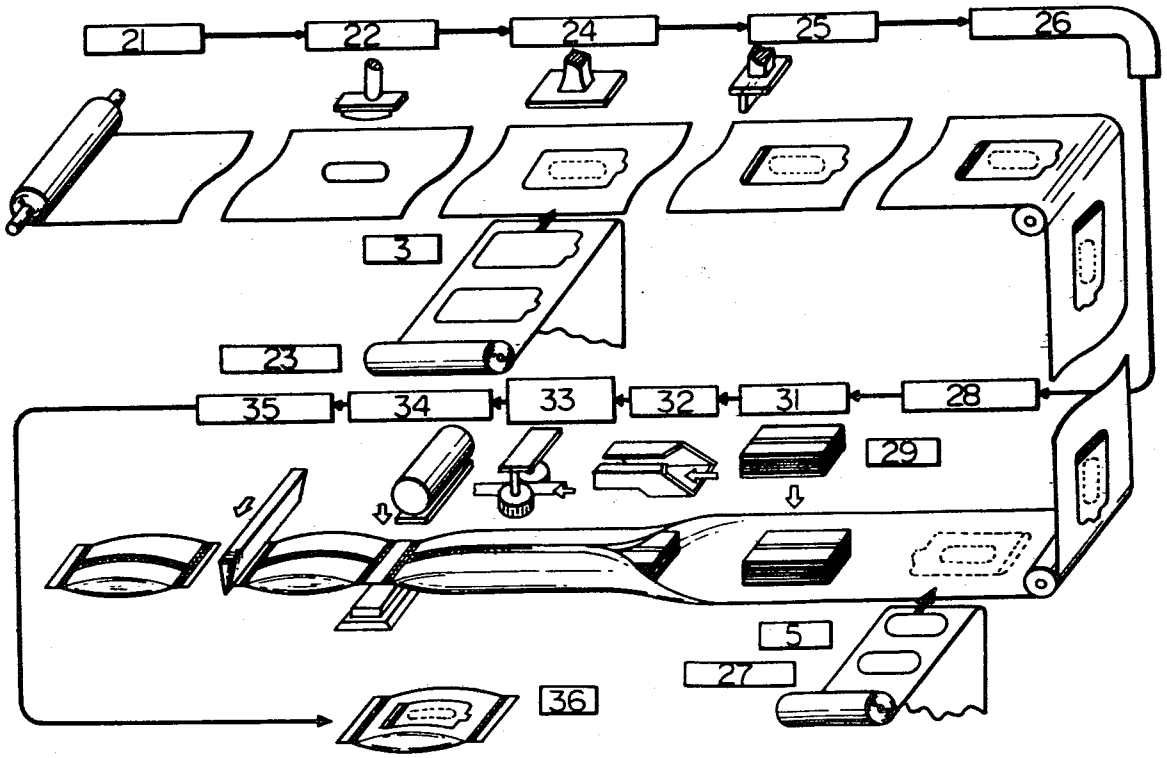
FIG. 16 is a flow sheet illustrating another process for producing a re-sealable dispenser-container of the invention.

Referring to FIG. 16, another embodiment of the process of the invention will be described. This process is almost similar to the process as shown in FIG. 15, except for the following points. According to the process of FIG. 16, an opening is formed in a sheet 21 for a main body of a container, by means of a punching machine 22. The opening is closed by a flap 3 with a pressure-sensitive adhesive surface. After turning over the sheet 21 which has been provided with a flap 3, a non-adhesive member 5, which has been mounted on a sheet 27 previously, is disposed on the sheet 21 for a main body so as to cover the opening with the member 5, by means of a machine for disposing a non-adhesive member 5 in place, so that the member 5 is adhered to the adhesive surface of the flap 3 through the opening. Then, a final product 36 is produced in the same manner as described regarding FIG. 15.

According to the embodiments of the process of the present invention, a re-sealable dispenser-container and/or contents contained in a re-sealable dispenser of the invention can be produced in series, however each step in the process may be carried out intermittently or step by step.

It should be apparent that the present invention may be embodied in other specific forms without departing from the basic idea or scope of this invention, all of which are intended to be encompassed by these claims.

I claim:

1. A re-sealable dispenser-container for containing sheet-like fiber material for make-up or toilet use, comprising a main body of the container made of impervious material and having at least one opening, a flap for covering said opening attached to said main body, and an adhesive layer formed on the surface of said flap which surface faces said opening, characterized by:

further comprising a non-adhesive member for covering said opening, said member having a shape similar to and larger than said opening and being disposed on the opening inside of the main body before using the container, whereas after use, said member is drawn out through the opening and attached to said flap.

* * * * *

UNITED STATES PATENT AND TRADEMARK OFFICE

CERTIFICATE OF CORRECTION

PATENT NO. : 4,420,080

DATED : 12/13/83

INVENTOR(S) : Kenji Nakamura

It is certified that error appears in the above-identified patent and that said Letters Patent is hereby corrected as shown below:

On title page of the patent, please insert the following paragraph

--FOREIGN APPLICATION PRIORITY DATA

| | | |
|---|---|---|
| Dec. 3, 1979 | Japan | 156676/79 |
| Dec. 3, 1979 | Japan | 167459/79 |
| May 22, 1980 | Japan | 70-397/80 |
| Aug. 13, 1980 | Japan | 111380/80 |
| Sept. 3, 1980 | Japan | 122010/80--. |

Signed and Sealed this

*Nineteenth* Day of *March 1985*

[SEAL]

*Attest:*

DONALD J. QUIGG

*Attesting Officer*

*Acting Commissioner of Patents and Trademarks*